United States Patent [19]

Mater

[11] 4,237,947

[45] Dec. 9, 1980

[54] COMPARTMENTALIZED COUPON CARRYING CASE

[76] Inventor: Carolyn V. Mater, 58 School Rd. West, Marlboro, N.J. 07746

[21] Appl. No.: 67,051

[22] Filed: Aug. 16, 1979

[51] Int. Cl.[3] ..... A45C 11/18

[52] U.S. Cl. ..... 150/39

[58] Field of Search ..... 150/39; 206/425; 40/124.2

[56] References Cited

U.S. PATENT DOCUMENTS 2,718,911 9/1955 Solomon ..... 150/39

3,759,305 9/1973 McIntyre ..... 150/39

4,004,690 1/1977 Giarritta ..... 150/39 X

FOREIGN PATENT DOCUMENTS 1024111 3/1966 United Kingdom ..... 150/39

*Primary Examiner*—Donald F. Norton

*Attorney, Agent, or Firm*—Charles I. Brodsky

[57] ABSTRACT

A coupon case constructed of a see-through plasticized material, pliable in composition to permit arrangement into individual compartmentalized sections and foldable to permit easy carrying about.

7 Claims, 3 Drawing Figures

COMPARTMENTALIZED COUPON CARRYING CASE

FIELD OF THE INVENTION

This invention relates to carrying cases, in general, and to one usable in carrying shopping coupons, in particular.

BACKGROUND OF THE INVENTION

As is well known and understood one of the most successful of the advertising promotions is that of the "cents-off" coupon, which permits shoppers added discounts in making their purchases. Whereas the more usual method of such distribution has been through advertising in the local newspapers, more and more, the fashion has been for distribution to be made through the mails to vast numbers of consumers, sending to them several coupons at a time for a wide diversity of products. This is not to say that newspaper advertising has taken a back seat to the more modernistic method of coupon mailings, but that the latter approach has been found to be somewhat more successful in reaching larger numbers of subscribers. Besides coupons of the "cents-off" variety being advertised, it goes without saying that other forms of advertising involve coupon cutting, such as where products are sold at a reduced price upon presentation of the coupon—sometimes, one to a person and sometimes, one to a family. As a result, coupon snipping and saving have almost become a way-of-life with the shopper of the family. In fact, magazine articles have been written about individual shoppers who have made an art of the "snipping and saving", to the extent that their visits to the supermarket permit them to purchase various goods at fractions of the usual price.

As will be apparent, with the large numbers of coupons available today—and with heavy reliance being placed upon them by the shopper during inflationary periods—, the need for being able to collect, sort, and carry such coupons will be appreciated. One product, presently on the market, comprises a coupon organizer of some three or four sections, but of a thin envelope type of construction. Because of its thinness, the section cannot easily be spread apart while the coupons are inside, to enable the user to quickly determine just what coupons are located therein. Because the compartments are constructed of an opaque material, furthermore, the coupons cannot be identified at all while they are within the case sections. Thus, when this widely advertised coupon organizer is used, the consumer, of necessity, must withdraw and remove all the coupons from the case in trying to locate those needed to give to the storekeeper in order to get the reduced prices associated with them.

SUMMARY OF THE INVENTION

As will become clear hereinafter, the carrying case of the present invention permits substantially more coupons to be carried, while at the same time, permitting visual observation of those coupons present, without having to remove them from the carrying case. As will be seen, the case of the invention is constructed of a see-through plastic material which is pliable in composition. The "see-through" nature permits visual observation of the coupon possessed, both from front and back views. The pliability of the fabrication permits easy expansion of the individual compartments, to increase the number of coupons held therein, and to permit a "spreading" about of them while they remain in the case, during attempts to locate them. As will be apparent, the case of the invention will be seen to comprise a separate unit—e.g., separate from a wallet or billfold, as compared to the coupon organizers of the prior art which serve as adjuncts to wallets, billfolds, purses, and the like, where the coupons are merely fitted into thin window sections in much the same manner as photographs are carried within a wallet's confines. Another feature of the present invention will be seen to be the arrangement by which it can be stored when not in use, and in a way which is particularly conducive to the addition of added coupons as they are cut from a newspaper, received in the mail, etc.

BRIEF DESCRIPTION OF THE DRAWING

These and other features of the present invention will be more particularly understood from a consideration of the following description taken in connection with the accompanying drawing in which.

DETAILED DESCRIPTION OF THE DRAWING

Figure 1:
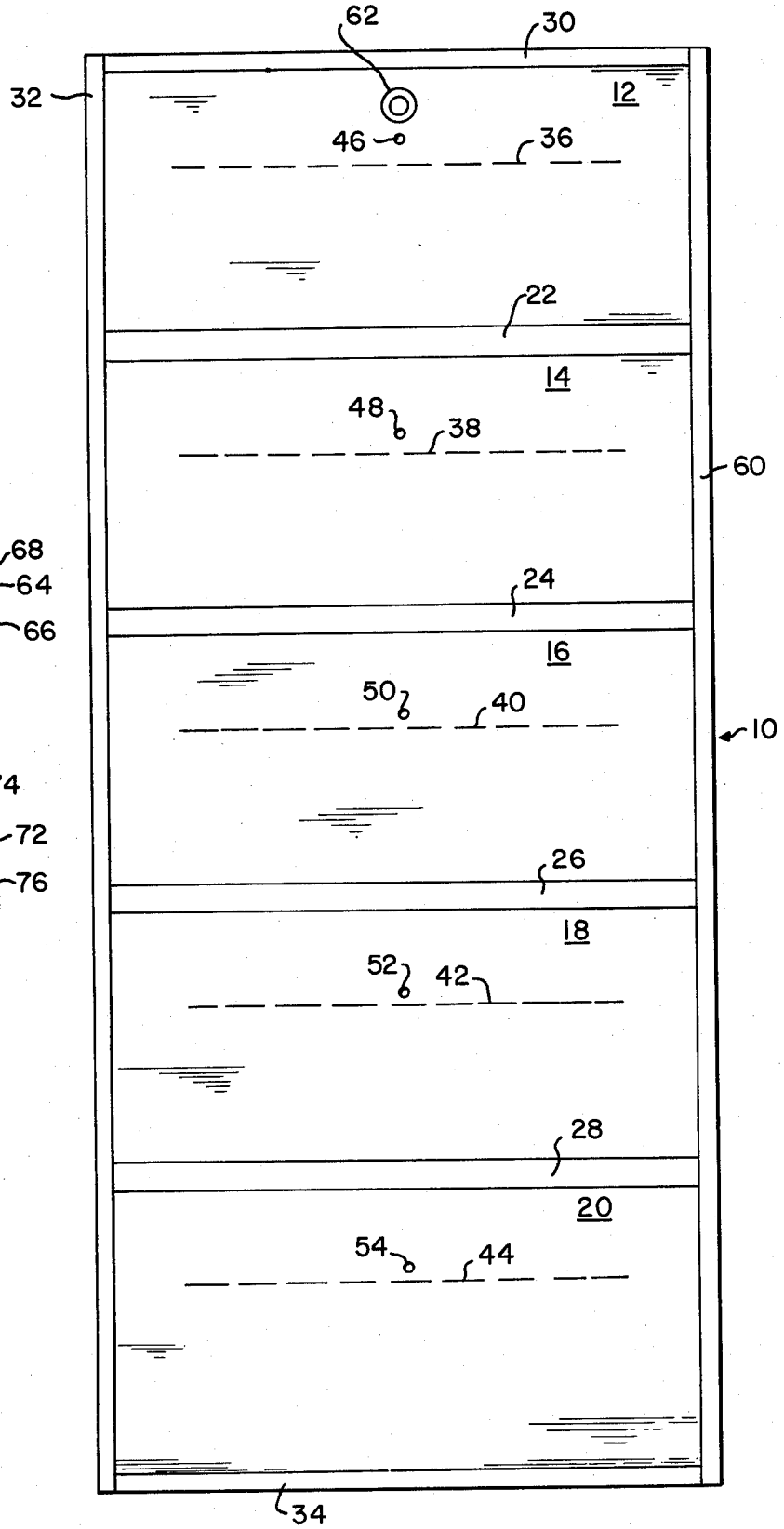
FIG. 1 illustrates a compartmentalized coupon carrying case constructed in accordance with the present invention.

Referring to FIG. 1 of the drawings, the compartmentalized carrying case 10 is shown as comprising five individual sections 12, 14, 16, 18, 20. In one preferred embodiment of the invention, the coupon carrying case was fabricated from a 9×40 piece of clear, see-through plastic material, folded over in half, to give a 9×20 over-all dimension. Five sections, of four inch width, were deemed to be adequate to carry the typical number of "cents-off" coupons, and markings made at such four inch intervals were made on each part of the folded-over plastic. A series of binding tapes—of ⅜ inch width, for example—22, 24, 26, 28 were inserted at these four inch spacings, between the two halves of the folded-over plastic, and sewn thereto in sandwich fashion, the binding tape being between the plastic. Additional binding tape 30, 32, and 34 were then sewn across the top of the folded-over plastic, along one of its sides, and at its bottom, respectively, being sewn over the binding tapes 22, 24, 26, 28 where they met. At such point in the construction, the carrying case consisted of five sections, each with an opened end, however.

Figure 2A:
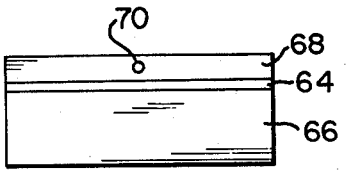
FIGS. 2*a* and 2*b* illustrate separate methods by which coupons may be inserted and held in place.
Figure 2B:
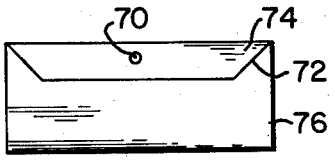

Reference numerals 36, 38, 40, 42, 44 each represent slits cut into the front half of the folded-over plastic, so as to permit insertion of any coupon within the section so formed. Although FIGS. 2*a* and 2*b* illustrate manners by which such slits can be arranged, it will be understood that the reference numerals 46, 48, 50, 52, 54 illustrate colored indicator dots which readily identify that position in the compartment, measured from top to bottom, at which the slit appears. By making such indicator dots of a red adhesive material, for example, little difficulty was experienced in knowing that at that point, the slit appeared for insertion of the coupon. After making the slits 36, 38, 40, 42 and 44—either by means of a razor blades, or scissor inserted through the open end of the section—, the remaining end of the carrying case is sealed by a further binding tape 60, being sewn—like the tapes 30, 32, 34 over the free edge of the clear-plastic and over the binding tapes 22, 24, 26 and 28. As shown in the drawing of FIG. 1, the binding tapes 32, and 60 overlie the tapes 30 and 34, as well. Because of the "body" given the construction by the tapes 22, 24, 26, 28, the fabrication can be folded over in yielding a case nine inches long, four inches wide and of a thickness of one inch or so, even when filled with coupons. A rubber band can be used to encircle the construction in holding it closed.

As will be apparent, one of the advantages of the construction described follows from the see-through nature of the plastic employed. Coupons inserted into the individual sections 12, 14, 16, 18, 20 can be observed from either side of the carrying case construction. A second advantage follows from the pliable composition of the plastic, by means of which many coupons can be inserted in each compartment, yet while moving the front area beneath the slit forward with respect to the back, so as to permit a flipping-through of the coupons while still within the case, and in a well lit area. One further feature follows from the use of a grommet, or similar securement means, by which the carrying case 10 can be held open—such as attached to a refrigerator or door—to enable coupons to be simply inserted as they are received in the mail or cut from a newspaper or magazine. This should be contrasted with the coupon organizers presently available, which are typically left closed until a number of coupons are received and then attempted to be inserted into the individual window envelopes on such prior art devices. With the hanging construction of the invention, it is no effort at all to merely insert a coupon into a section at a time. The arrangement of FIG. 2*a* illustrates one of the sections of the carrying case, with a slit 64 of some ⅛ inch thickness. The coupon is fitted within the slit 64, and held in place by the plastic section beneath the slit, and by that above the slit, denoted by the reference numerals 66, 68. The colored indicator dot is shown at 70. The arrangement of FIG. 2*b*, on the other hand, shows the slit 72 as constructed in a channel arrangement to form a flap 74 which overlies the coupon inserted in place to be held by the lower plastic section 76. Whereas the arrangement of FIG. 2*b* might be preferable where many coupons are to be inserted within the individual section, the arrangement is less desirable than that of FIG. 2*a*, because of the tendency of the flap 74 to curl upwardly as the individual sections are folded over. In other words, in most usages, the slit arrangement of FIG. 2*a* is the more slightly. With either slit construction, however, it has been found that the compartmentalized carrying case of the invention can be easily folded over, taken to the store when shopping and easy to permit withdrawal of the desired coupon and of observing the coupons while in the individual sections.

While there have been described what are considered to be preferred embodiments of the present invention, it will be readily understood that modifications can be made by those skilled in the art without departing from the scope of the teachings herein. Thus, whereas preferred dimensions have been set forth in fabricating a five section compartment case of some nine inch width, it will be apparent that other dimensions can be selected for a carrying case of different number of sections, or of different lengths, widths, and/or thicknesses. For at least reasons, therefore, resort should be had to the claims appended hereto for a true understanding of the scope of the present invention.

I claim:

1. A coupon carrying case comprising:

front and back portions of a see-through material composition;

first means securing together respective top, bottom and side edges of said front and back portions;

second means predeterminedly positioned from top to bottom of said front and back portions and secured thereto, to compartmentalize said front and back portions into individualized sections; and third means forming an opening along each individualized section so formed, and extending towards opposite side edges of said sections, to permit thereby insertion of coupons or other writings into said sections; and wherein said first means comprises binding tape means overlying the top, bottom and side edges of said front and back see-through material portions.

2. The coupon carrying case of claim 1 wherein said front and back portions are constructed of a plasticized composition sufficiently pliable to permit fold-over of the individualized sections so formed, one atop the other.

3. The coupon carrying case of claim 1 wherein fourth means are included adjacent the top edge of said back portion, to permit holding of said case in open, unfolded position when not being carried about.

4. The coupon carrying case of claim 3 wherein fifth means are included adjacent said third means to enhance the determination of locating said third means for inserting coupons in place in the individualized sections so formed.

5. The coupon carrying case of claim 4 wherein said third means extends between opposite side edges of said individualized sections in forming the opening for coupons to be inserted in said sections.

6. The coupon carrying case of claim 1 wherein said individualized sections are constructed of a nine inch length and four inch width.

7. The coupon carrying case of claim 1 wherein said second means comprises binding tape means interposed between said front and back see-through material portions which overlie it.

* * * * *